United States Patent [19]

John

[11] Patent Number: 4,834,162

[45] Date of Patent: May 30, 1989

[54] VERTICAL LOUVER BLIND OPERATING MECHANISM

[75] Inventor: Julius F. John, Redondo Beach, Calif.

[73] Assignee: Home Fashions, Inc., Santa Monica, Calif.

[21] Appl. No.: 102,865

[22] Filed: Sep. 30, 1987

[51] Int. Cl.[4] ..... E06B 9/30

[52] U.S. Cl. ..... 160/168.1; 160/176.1; 160/178.1; 160/900

[58] Field of Search ..... 160/166 R, 166 A, 168 R, 160/168 A, 176.1, 178.1, 900

[56] References Cited

U.S. PATENT DOCUMENTS

| | | | |
|---|---|---|---|
| 2,898,986 | 11/1959 | Kiefer . | |
| 3,789,905 | 2/1974 | Saito . | |
| 3,878,877 | 4/1975 | Bruneau et al. . | |
| 4,047,554 | 9/1977 | Bullat . | |
| 4,103,727 | 8/1978 | Spohr . | |
| 4,262,728 | 4/1981 | Debs . | |
| 4,293,021 | 10/1981 | Arena | 160/166 A X |
| 4,306,608 | 12/1981 | Frentzel et al. . | |
| 4,332,288 | 6/1982 | Frentzel et al. . | |
| 4,335,775 | 6/1982 | Frentzel et al. . | |
| 4,425,956 | 1/1984 | Terlecke . | |
| 4,552,195 | 11/1985 | Durig et al. | 160/166 A X |
| 4,648,436 | 3/1987 | Oskam . | |

*Primary Examiner*—Blair M. Johnson
*Attorney, Agent, or Firm*—Welsh & Katz, Ltd.

[57] ABSTRACT

A venetian blind of the vertical louver type includes an elongated guide track and a plurality of louver carriers supported by the guide track for traverse between open blind and closed blind conditions, each of the louver carriers supporting a louver in generally vertical orientation for traverse with the carrier and for rotation about its longitudinal axis between open and closed louver positions. A louver control mechanism is supported on one end of the guide track and is operative to rotate the louvers to open louver positions prior to traverse along the guide track from a closed blind condition to an open blind condition. In the disclosed embodiment, a rotation rod extends longitudinally of the guide track in cooperative relation with the louver carriers and supports a spool which is actuated by a beaded chain to rotate the rotation rod and effect rotation of the louvers. A pullcord is operative to traverse the louvers along the guide track and is cooperative with the spool such that actuation of the pullcord to effect traverse of the louvers to an open blind condition first rotates the louvers to open louver positions.

12 Claims, 2 Drawing Sheets

VERTICAL LOUVER BLIND OPERATING MECHANISM

BACKGROUND OF THE INVENTION

The present invention relates generally to venetian blinds of the vertical louver type, and more particularly to a novel operating mechanism for selectively traversing and rotating the louvers and which insures that the louvers are in open louver positions prior to traverse of the louvers from a closed blind to an open blind condition.

Venetian blinds of the vertical louver type employing an elongated guide track or headrail which supports a plurality of louver carriers movable along the guide track and supporting louvers in generally vertical orientation are generally known. Such vertical louver blinds include a louver control mechanism which enables selective traverse of the louver carriers between open blind and closed blind conditions, and facilitates rotation of the louvers about their longitudinal axes between open louver positions lying in planes substantially transverse to the longitudinal axis of the guide track, and closed louver positions wherein the louvers lie in planes substantially parallel to a vertical plane containing the longitudinal axis of the track, whereby to enable selective control of the amount of light passing through the blind.

A preferred operating mode for vertical louver blinds is to rotate the vertical louvers to their open louver positions prior to traversing the louvers from closed blind to open blind conditions. If the louver carriers are caused to traverse the guide track toward an open blind condition while the louvers are in their closed positions lying in planes substantially parallel to a vertical plane containing the longitudinal axis of the guide track, the louvers may jam and cause damage to the control mechanism and/or to the louvers themselves. Such jamming and louver damage only occurs when the louvers are being traversed to their open blind condition wherein the louvers are disposed at opposite ends of the guide track, in the case of a split blind, or at one end of the guide track in the case of a single panel blind. Accordingly, should an operator fail to rotate the louvers to their open louver positions prior to causing the louvers to traverse the guide track toward an open blind condition, substantial damage may be caused to the louvers as well as to the control mechanism.

Attempts have been made to overcome the aforedescribed problem by provding vertical louver control or operating mechanisms which cause the louvers to be first moved to their open louver positions transverse to the longitudinal axis of the associated guide track prior to traversing the louvers from closed blind to open blind conditions. See, for example, U.S. Pat. Nos. 2,898,956, 3,789,905, and 3,878,877. The vertical louver control mechanisms disclosed in these patents are relatively complex, thus being expensive to manufacture as well as leading to increased servicing costs in the event of malfunction.

SUMMARY OF THE INVENTION

One of the primary objects of the present invention is to provide a novel louver control mechanism for use with a vertical louver type venetian blind, the louver control mechanism being operative to rotate the louvers to open louver positions prior to traversing the louvers from closed blind to open blind conditions so as to prevent damage to the louvers or control mechanism during opening of the blind.

A more particular object of the present invention is to provide a novel louver control mechanism for use with a vertical louver type venetian blind having a guide track or headrail supporting a plurality of louver carriers each of which supports a louer in a generally vertical orientation. The louver carriers enable rotation of the associated louvers about their longitudinal axes and traversing of the louvers between closed and open blind conditions. A rotation rod extends longitudinally of the guide track and cooperates with the louver carriers so as to effect rotation of the louvers upon rotation of the rotation rod through a beaded-chain operated spool member mounted on a control end of the rotation rod. The louver carriers are caused to traverse the guide track by a pullcord which also cooperates with the spool member in a manner to automatically rotate the louvers to their open louver positions prior to traverse from closed blind to open blind conditions.

A feature of the louver control mechanism in accordance with the invention lies in routing a reach of the traversing pullcord along the centerline of the rotation rod control spool member and generally radially outwardly therefrom such that rotation of the louvers after traversing the guide track to a closed blind condition causes the pullcord to be wrapped about the spool so that subsequent actuation of the pullcord to move the louvers to an open blind condition first automatically rotates the louvers to open louver positions.

Further objects, features and advantages of the invention, together with the organization and manner of operation thereof, will become apparent from the following detailed description of the invention when taken in conjunction with the accompanying drawings wherein like reference numerals designate like elements throughout the several views.

DETAILED DESCRIPTION

Figures 1, 2:
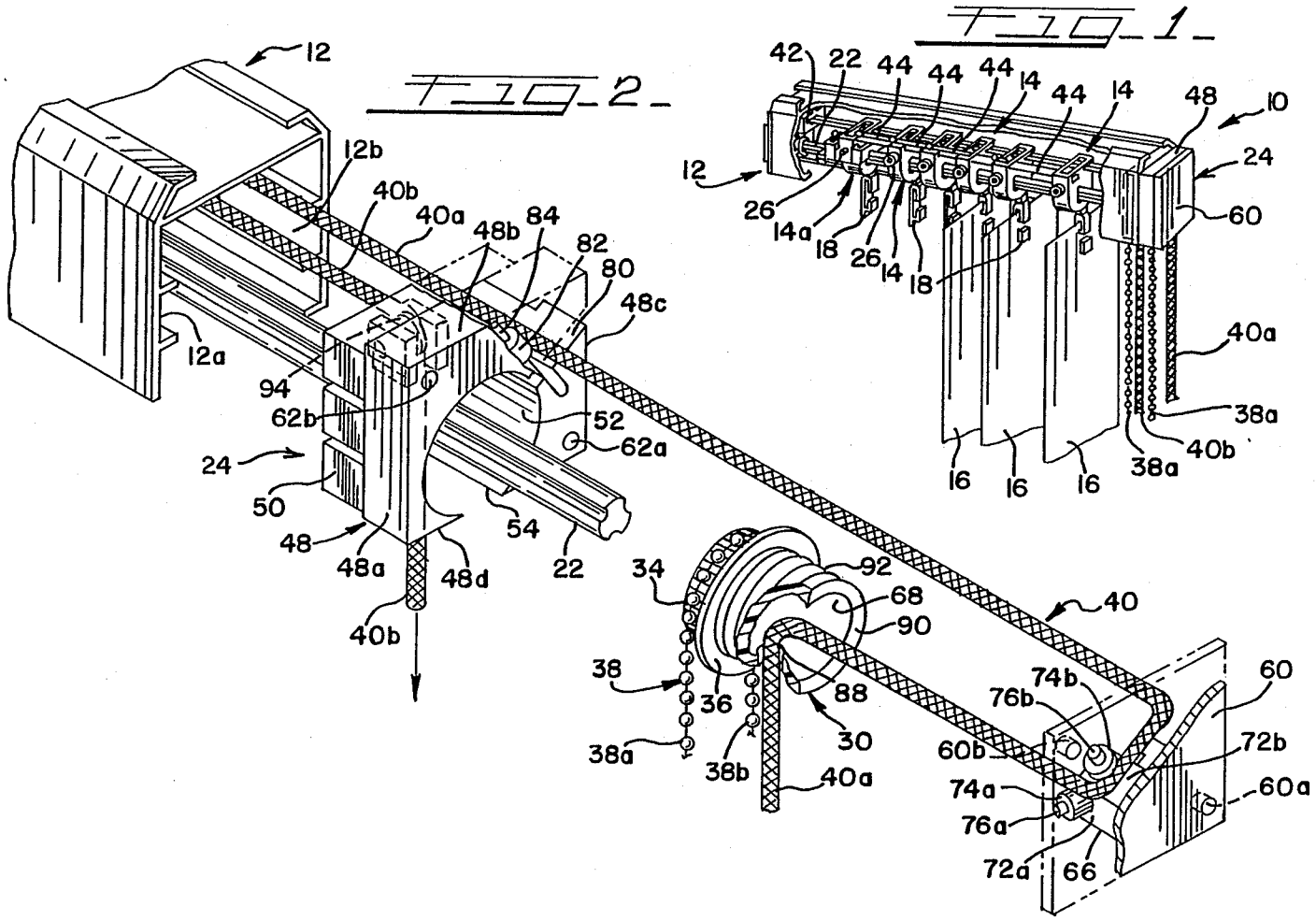
FIG. 1 is a fragmentary perspective view illustrating a vertical louver type venetian blind having a louver control mechanism in accordance with the present invention.
FIG. 2 is an exploded fragmentary perspective view of the louver control mechanism employed in the vertical louver venetian blind of FIG. 1.

Referring now to the drawings, FIG. 1 illustrates a venetian blind assembly, indicated generally at 10, of the vertical louver type. The venetian blind assembly 10 includes an elongated guide track or headrail, indicated generally at 12, which supports a plurality of the louver carriers or trucks 14 adapted to traverse the guide track 12 between open and closed blind conditions. Each of the louver carriers 14 releasably supports an elongated louver 16 in a generally vertical orientation through a hook-like hanger 18. The hangers 18 are rotatable about vertical axes in response to rotation of a rotation rod 22 which extends longitudinally of the guide track and cooperates with each of the carriers 14. Louver control mechanism means, indicated generally at 24, is mounted at one end of the guide track 12 and cooperates with the rotation rod 22 and louver carriers 14 to enable selective traverse of the louvers along the guide track and rotation of the louvers about their longitudinal axes.

As illustrated in FIG. 2, the guide track 12 defines a pair of laterally opposed longitudinally extending open channels or tracks 12*a* and 12*b* which receive axially aligned pairs of wheels 26 on each of louver carriers 14 so as to support the louver carriers and facilitate traverse along the guide track. Each hanger 18 has a spur gear (not shown) formed on its upper end within the corresponding louver carrier 14 which meshes with an associated worm gear (not shown) carried within the louver carrier in a known manner. The rotation rod 22 extends through each louver carrier axially of its associated internal worm gear so as to enable traverse of the carriers along the rotation rod while being operative to effect simultaneous rotation of the hangers 18 and louvers 16 upon selective rotation of the rotation rod. To this end, the rotation rod 22 is of irregular cross-sectional configuration, such as being longitudinally fluted, and is received through a similarly configured axial bore through the worm gear within each of the louver carriers 14. The louvers 16 re thus rotatable between open louver positions, wherein the louvers lie in planes substantially transverse or perpendicular to the longitudinal axis of the guide track 12 as illustrated in FIG. 1, and angled or closed louver positions wherein the louvers 16 lie in planes forming an included angle between zero (louver fully closed position) and 90° with a vertical plane containing the longitudinal axis of the guide track. In a conventional installation, the guide track 12 is frequently straight and is affixed to a generally horizontal surface adjacent and parallel to a window so that the louvers may alternatively be defined as being movable between open louver positions lying in planes substantially perpendicular or normal to the corresponding window, and partially or fully closed positions wherein they lie in planes angled less than 90° to the window. It will be understood that the guide track may also be curved if desired.

Figure 6:
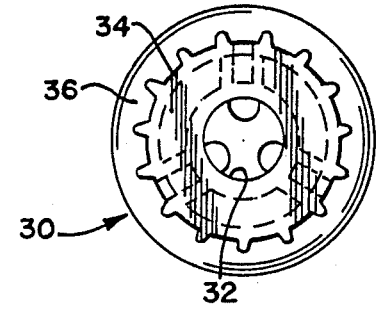
FIG. 6 is an end view of the rotation rod control spool removed from the rotation rod and viewed from the sprocket end thereof.

To effect selective rotation of the rotation rod 22, the louver control mechanism means 24 includes first actuator means in the form of a rotation drive spool member 30 (FIG. 2) adapted for mounting on a corresponding end of the rotation rod 22 in positive relation therewith such that rotation of the spool 30 about its longitudinal axis is operative to effect a corresponding rotation of the rotation rod 22. As shown in FIG. 6, the spol member 30 has an axial bore 32 therethrough having a transverse configuration substantially identical to the transverse configuration of rotation rod 22 so as to slidingly receive the rotation rod while being positively rotationally coupled thereto. The spool 30 has an annular drive sprocket 34 formed thereon forewardly of a radial flange 36. The annular sprocket 34 cooperates with an endless beaded chain 38 which extends downwardly from the control mechanism means 24 and facilitates selective rotation of the spool and thereby the rotation rod 22 through downward pulling of either of the depending reaches 38*a* and 38*b* of the beaded chain. Thus, downward pulling on the reach 38*a* is operative to effect rotation of the louvers 16 in one rotational direction about their longitudinal axes, while downward pulling on reach 38*b* is operative to rotate the louvers in an opposite rotational direction about their longitudinal axes.

To effect traverse of the louver carriers 14 along the guide track 12, second actuator means in the form of a pullcord 40 is supported within the guide track and looped about an idler pulley (not shown) in an idler end cap 42 (FIG. 1) at the opposite end of the guide track from the control mechanism means 24, alternatively termed the control end cap. In this manner, the pullcord defines a pair of longitudinally extending reaches 40*a* and 40*b* which pass through openings in the louver carriers. In the illustrated single panel blind, the pullcord reach 40*a* is secured to the louver carrier 14a farthest from the control endcap 24 such that longitudinal movement of reach 40*a* effects a corresponding traverse of the louver carrier 14*a*, termed the lead louver carrier. Conventional separation limiting means in the form of lost-motion connector bars 44 (FIG. 1) connect the successive louver carriers 14 to each other such that traverse of the lead carrier 14*a* from a position wherein the louver carriers are in an open blind condition generally adjacent the control end cap 24 to a position along the length of the guide track 12 by pulling on pullcord reach 40*b* effects a corresponding movement of each succeeding louver carrier when a predetermined distance has been attained between each louver carrier and the next successive carrier, as is known. Conversely, when the pullcord reach 40*a* is pulled to effect traverse of the lead louver carrier 14*a* toward the control end cap 24, the connector bars 44 allow the lead louver carrier 14*a* to first abut the next adjacent louver carrier and effect a corresponding movement thereof until the next adjacent louver carrier is engaged, and so on until all of the louver carriers have been moved to the open blind condition generally adjacent the control end cap 24. As aforementioned, the louver carriers 14 and associated vertical louvers 16 may be separated such that one half of the louvers are moved to and from the return end cap 42 on the guide track and the other half are moved to and from the opposite end of the guide track, both sets of louvers being generally equally spaced along the length of the guide track when in a closed blind condition.

Figure 3:
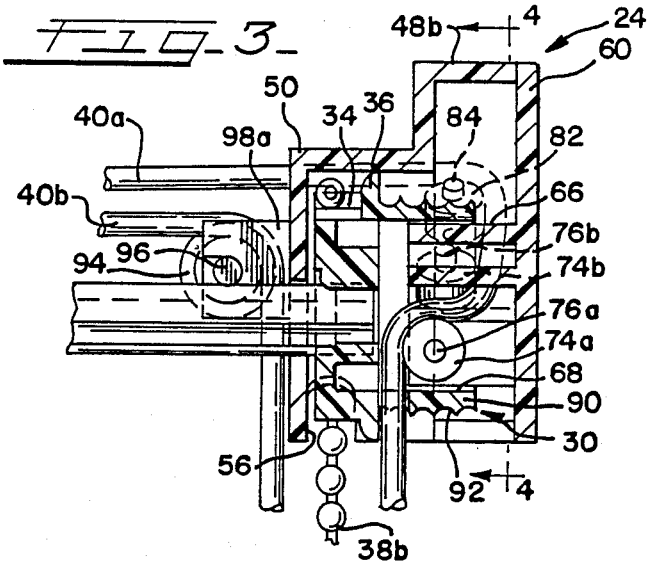
FIG. 3 is a fragmentary vertical longitudinal sectional view of the louver control mechanism removed from the guide track or headrail.

In accordance with an important feature of the invention, the pullcord 40 of the second actuator means is operatively associated with the spool member 30 of the first actuator means such that actuation of the pullcord to traverse the louvers 16 from a closed blind condition to an open blind condition first effects rotation of the louvers to their open louver positions lying in planes substantially transverse to the longitudinal axis of the guide track. Referring particularly to FIGS. 2–5, the control mechanism means 24 includes an endcap housing 48 having a rectangualr external configuration such that its external wall surfaces 48*a–d* are substantially coplanar with corresponding outer wall surfaces of the guide track 12 when a reduced size rectangular end 50 of the endcap is mounted within an open end of the guide track. The endcap housing 48 may be made of a suitable plastic material and has a cylindrical bore 52 formed longitudinally therein which receives the spool member 30 when mounted on an end of the rotation rod 22 extending into the bore 52 through a circular opening 50*a* in the endcap housing. The bore 52 intersects the lower surface 48*d* of the endcap housing to define a rectangular opening 54 which intersects a generally rectangular opening 56 formed upwardly from the lower surface of the reduced end 50 as shown in FIGS. 3 and 5.

A rectangular cover plate 60 is adapted for mounting on the outer end of the endcap housing 48 through a pair of pilot pins 60*a* and 60*b* projecting from the cover plate and received within bores 62*a* and 62*b* formed in the endcap housing to establish predetermined orientation of the cover plate 60 on the endcap housing. The cover plate 60 may also be made of a suitable plastic material and has a generally cylindrical boss 66 received within a cylindrical bore 68 formed axially of spool 30. The boss 66 has an outer diameter slightly less than the diameter of bore 68 so as to stabilize the spool 30 during rotation within the bore 52 of the endcap housing 48.

Figure 4:
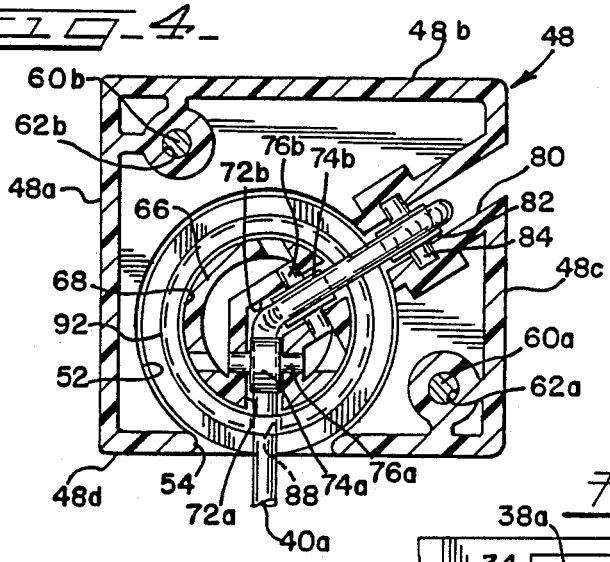
FIG. 4 is a transverse sectional view taken substantially along line 4—4 of FIG. 3.
Figure 5:
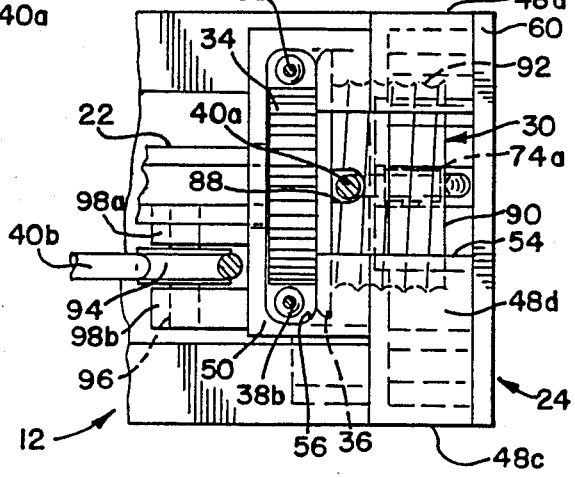
FIG. 5 is a bottom view of the louver control mechanism of FIG. 1.

As illustrated in FIG. 4, a pair of radial intersecting slots or recesses 72*a* and 72*b* are formed in the boss 66 to receive rotatable pulleys 74*a* and 74*b* which are mounted, respectively, on support shafts 76*a* and 76*b*. The pulleys 74*a* and 74*b* serve to guide the reach 40*a* of pullcord 40 into the bore 68 in spool 30 along the rotational axis of the spool. The reach 40*a* of the pullcord which extends longitudinally within the guide track 12 from the idler end cap 42 is passed through a slot or recess 80 formed in the endcap housing 48 and reeved about a pulley 82 rotatably supported on a support shaft 84 within slot 80. The pullcord is passed about pulley 82 and about the pulleys 74*a* and 74*b* after which it passes radially outwardly through an opening 88 formed in an annular wall 90 fo the spool 30 which defines the bore 68. The outer surface of the annular wall 90 has a spiral fluting 92 formed thereabout such that with the pullcord reach 40*a* extending generally radially through the opening 80, rotation of the spool causes the reach 40*a* to be wrapped about the fluted surface 92 in spiral fashion.

The reach 40*b* of pullcord 40 which extends longitudinally of the guide track 12 from the idler end cap 42 is passed about a pulley 94 rotatably supported on a substantially horizontal support shaft 96 between a pair of spaced walls 98*a* and 98*b* extending outwardly from the end 50 of endcap housing 48. The pullcord reach 40*b* passes over pulley 94 and downwardly generally parallel to the depending pullcord reach 50*a*.

In operation, and assuming a venetian blind condition wherein the vertical louvers 16 and associated louver carriers 14 are in an open blind condition disposed generally adjacent the control end of the guide track 12, and further assuming that the louvers 16 are disposed in planes substantially transverse or perpendicular to the longitudinal axis of the guide track 12, the depending reach 40*b* of the pullcord is first pulled downwardly to cause the louver carriers to traverse the guide track toward a closed blind condition. The separation limiting bars 42 are operative to effect substantially equal spacing between the louvers along the guide track when the lead louver carrier 14*a* has traversed substantially the full length of the guide track.

With the louvers 16 being thus disposed in a closed blind condition, rotation of the louvers about their vertical longitudinal axes is effected by pulling on either of the reacher 38*a* or 38*b* of the pull chain 38 to effect selective rotation of the spool 30 and rotation rod 22. In this manner thelouvers 16 may be rotated in either rotational direction about their longitudinal axes between open louver positions lying in planes transverse to the longitudinal axisof the guide track and closed louver positions wherein the louvers lie in planes substantially parallel to a vetical plane containing the longitudinal axis of the guide track. As the spool 30 is rotated to effect desired rotation of the louvers 16, the reach 40*a* of the pullcord which extends through the spool opening 88 is spirally wound or wrapped about the fluted surface 92. Thereafter, when it is desired to traverse the louvers 16 from their closed blind to open blind conditions, the depending pullcord reach 40*a* is pulled downwardly. This causes the spool 30 to be rotated in an opposite direction to the direction of rotation which initially caused the pullcord to be wrapped about the spool, until the portion of the pullcord which had previously been wrapped about the spool is unwrapped. Such reverse rotation of the spool during unwrapping of the pullcord causes the louvers 16 to be returned to their open louver positions. Thereafter further downward pulling on reach 48*a* causes traverse of the louver carriers 14 and associated louvers 16 to their open blind condition. In this manner, movement of the pullcord 40 in a direction to traverse the louvers to an open blind condition first automatically rotates the louvers 16 to open louver positions, thus preventing traverse of the louvers 16 to an open blind condition while in closed louver positions which could cause damage to the louvers and/or the louver control mechanism means.

Thus, in accordance with the present invention, a venetian blind assembly of the vertical louver type is provided which is of relatively simple construction and which employs a louver control mechanism operative to automatically rotate the louvers to full open louver positions lying in planes substantially transverse to the longitudinal axis of the guide track prior to traversing the louvers along the guide track from a closed blind to an open blind condition. Damage to the louvers and/or control mechanism as has heretofore been experienced is thus eliminated with the louver control mechanism in accordance with the invention. The various components of the louver control mechanism may be made of a suitable plastic material.

While a preferred embodiment of the invention has been illustrated and described, it will be understood that changes and modifications may be made therein without departing from the invention in its broader aspects. For example, the beaded chain and pullcord normally operative to effect, respectively, rotation of the louvers about their longitudinal axes and traverse along the guide track, may comprise alternative types of chains or pullcords which facilitate operation of the louver control mechanism. Various features of the invention are defined in the following claims.

What is claimed is:

1. A louver control mechanism for use in a venetian blind assembly of the vertical louver type having an elongated guide track, at least one louver carrier adapted to traverse said guide track and having means adapted to support a louver in a generally vertical orientation for rotation about its longitudinal axis, and a rotation rod extending longitudinally of said guide track and having cooperation with said louver carrier in a manner to effect rotation of the associated louver about its longitudinal axis between an open louver position and a closed louver position upon selective rotation of said rotation rod, said louver control mechanism being adapted for mounting adjacent the guide rail and comprising first actuator means including a spool member coupled to said rotation rod so as to effect rotation of said rod upon rotation of said spool member, said louver control mechainsm further including second actuator means having a pullcord operatively associated with said louver carrier in a manner enabling selective traverse of said louver carrier along said guide track between open and closed blind conditions, said pullcord being cooperative with said spool member so as to be wrapped about said spool member during rotation thereof to rotate said louver toward a closed louver position, actuation of said pullcord to traverse said louver from a closed blind to an open blind condition first effecting rotation of said louver to its open louver position.

2. A louver control mechanism as defined in claim 1 wherein said spool member is mounted coaxially on said rotation rod in positive rotational relation therewith, and including control chain means cooperative with said spool so as to enable selective rotation thereof to selectively rotate said rotation rod, said pullcord being wrapped about said spool member during rotation of said spool member to rotate said louver from an open louver toward a closed louver position so that subsequent actuation of said pullcord to traverse said louver from a closed to an open blind condition first automatically returns said louver to an open louver position prior to traversing said guide track.

3. A louver control mechanism as defined in claim 1 including a plurality of said louver carriers supported by and adapted to traverse said guide track, each of said louver carriers being cooperative with said rotation rod and supporting a vertical louver for rotation about is longitudinal axis upon rotation of said rotation rod, said a pullcord being operative to effect traverse of said louver carriers along said guide track and cooperative with said spool member such that actuation of said pullcord to traverse said louvers from a closed to an open blind condition first effects rotation of all of said louvers to open louver positions.

4. A louver control mechanism as defined in claim 3 wherein said louver control mechanism includes means operative to guide said pullcord along the rotational axis of said spool member and generally radially outwardly therefrom such that rotation of said rotation rod causes said pullcord to be wrapped about said spool member so that actuation of said pullcord to traverse said louvers to an open blind condition first rotates said louvers to open louver positions.

5. A louver control mechanism for use in a venetian blind assembly of the vertical louver type having an elongated guide track, at least one louver carrier adapted to traverse said guide track and having means adapted to support a louver in a generally vertical orientation for rotation about its longitudinal axis, and a rotation rod extending longtudinally of said guide track and having cooperation with said louver carrier in a manner to effect rotation of the associated louver about its longitudinal axis between an open louver position and a closed louver position upon selective rotation of said rotation rod, said louver control mechanism being adapted for mounting adjacent an end of the guide rail and comprising first actuator means including a spool member mounted coaxially on said rotation rod in positive rotational relation therewith, said spool member defining an extenral sprocket surface, and control chain means engaging said sprocket surface such that longitudinal movement of said chain means effects rotation of said spool member, said louver control mechanism further comprising second actuator means including a pullcord extending longitudinally of said guide track in cooperative relation with said louver carrier so as to facilitate traverse of said carrier along said guide track in response to longitudinal movement of said pullcord, said pullcord being guided along the rotation axis of said spool member and extending outwardly therefrom such that rotation of said spool member when rotating said rotation rod to rotate said louver toward a closed louver position causes said pullcord to be wrapped about said spool member so that actuation of said pullcord to effect traverse of said carrier along said guide track from a closed toward an open blind condition first effects return of said louver to an open louver position.

6. A louver control mechanism for use in a venetian blind assembly of the vertical louver type having an elongated guide track, at least one louver carrier adapted to traverse said guide track and having means adapted to support a louver in a generally vertical orientation for rotation about its longitudinal axis, and a rotation rod extending longitudinally of said guide track and having cooperation with said louver carrier in a manner to effect rotation of the associated louver about its longitudinal axis between an open louver position and a closed louver position upon selective rotation of said rotation rod, said louver control mechanism including an endcap housing adapted to be mounted on an end of said guide track and receive said rotation rod therein, said louver control mechanism further comprising first actuator means including a spool member received within said endcap housing for mounting on said rotation rod so as to effect rotation of said rotation rod upon rotation of said spool member, said louver control mechanism further comprising second actuator means including a pullcord operatively associated with said louver carrier in a manner to effect traverse thereof along said guide track in response to longitudinal movement of said pullcord, said pullcord being cooperative with said spool so as to be wrapped about said spool upon rotation thereof to effect rotation of said louver, longitudinal movement of said pullcord in a direction to effect traverse of said louver carrier from a closed to an open blind condition being operative to first effect rotation of said louver to an open louver position.

7. A louver control mechanism as defined in claim 6 wherein said pullcord defines a reach extending longitudinally of said guide track, said endcap housing including guide means operative to guide said pullcord along the rotational axis of said spool member and generally radially outwardly therefrom.

8. A venetian blind assembly of the vertical louver type comprising, in combination, an elongated guide track, a plurality of louver carriers supported by said guide track for traverse longitudinally thereof, a louver supported by each of said louver carriers in generally vertical orientation for rotation about its longitudinal axis and movement with said carrier between open blind and closed blind conditions, a rotation rod extending longitudinally of said guide track and cooperative with said louver carriers in a manner to effect rotation of said louvers about their longitudinal axes upon rotation of said rotation rod, first actuator means including a spool member coupled to said rotation rod so as to effect rotation thereof to rotate said louvers between open louver and closed louver positions upon rotation of said spool member, and second actuator means including a pullcord cooperative with said louver carriers in a manner enabling selective traverse of said louvers between said open blind and closed blind conditions, said pullcord being cooperative with said spool member so as to be wrapped about said spool member during rotation thereof to rotate said louvers from their said open louver to their said closed louver positions, actuation of said pullcord to effect traverse of said louvers from closed blind to open blind conditions first effecting rotation of said louvers to open louver positions.

9. A venetian blind assembly as defined in claim 8 wherein said spool member is mounted coaxially on said rotation rod in positive rotational relation therewith, and including control chain means cooperative with said spool member so as to enable selective rotation thereof to selectively rotate said rotation rod.

10. A venetian blind assembly as defined in claim 9 wherein said spool member defines an external sprocket surface engaged by said control chain means such that longitudinal movement of said chain means effects rotation of said spool member, said pullcord extending longitudinally of said guide track in cooperative relation with said louver carriers so as to facilitate traverse of said carriers along said guide track in response to longitudinal movement of said pullcord, said pullcord being guided along the rotational axis of said spool member and extending outwardly therefrom such that rotation of said spool member when rotating said rotation rod causes said pullcord to be wrapped about said spool member.

11. A venetian blind assembly as defined in claim 8 wherein said louver control mechanism includes an endcap housing adapted to be mounted on an end of said guide track and receive said rotation rod therein, said spool member being received witin said endcap housing spool member, said pullcord being operatively associated with said louver carriers in a manner to effect traverse thereof along said guide track in response to longitudinal movement of said pullcord.

12. A venetian blind assembly as defined in claim 11 wherein said pullcord defines a reach extending longitudinally of said guide track, said endcap housing including guide means operative to guide said pullcord along the rotational axis of said spool member and generally radially outwardly therefrom.

* * * * *

UNITED STATES PATENT AND TRADEMARK OFFICE

CERTIFICATE OF CORRECTION

PATENT NO. : 4,834,162

DATED : May 30, 1989

INVENTOR(S) : Julius F. John

It is certified that error appears in the above-identified patent and that said Letters Patent is hereby corrected as shown below:

Column 1, line 50, "provding" should be --providing--.

Column 2, line 7, "louer" should be --louver--.

Column 3, line 55, "spol" should be --spool--.

Column 5, line 43, "50a" should be --40a--.

Column 5, line 61, "reacher" should be --reaches--.

Column 5, line 63, "thelouvers" should be --the louvers--.

Column 5, line 66, "axisof" should be --axis of--.

Column 5, line 68, "vetical" should be --vertical--.

Column 7, line 30 delete "a".

Column 10, line 9, "witin" should be --within--.

Column 10, line 10, delete "spool member".

Signed and Sealed this

Eighth Day of May, 1990

*Attest:*

HARRY F. MANBECK, JR.

*Attesting Officer*

*Commissioner of Patents and Trademarks*